United States Patent [19]

Speer et al.

[11] Patent Number: 4,476,653

[45] Date of Patent: Oct. 16, 1984

[54] DOOR SILL AND ADJUSTABLE THRESHOLD

[75] Inventors: Wayne Speer, Temple, Tex.; John M. Chupik, Box 1008, Temple, Tex. 76501

[73] Assignee: John M. Chupik, Temple, Tex.

[21] Appl. No.: 456,763

[22] Filed: Jan. 10, 1983

[51] Int. Cl.[3] ..... E06B 1/70
[52] U.S. Cl. ..... 49/468
[58] Field of Search ..... 49/468

[56] References Cited

U.S. PATENT DOCUMENTS 3,273,287 9/1966 Pease, Jr. ..... 49/468
4,352,258 10/1982 Barek et al. ..... 49/468

*Primary Examiner*—Kenneth Downey
*Attorney, Agent, or Firm*—Littlepage & Webner

[57] ABSTRACT

A wooden door sill has an inclined tread portion rising to a threshold which lies beneath the door when the latter is closed. The threshold has a longitudinal upwardly-open groove containing a strip. In order to provide an adjustable fit of the strip against the under edge of the door, the strip is screwed down against a resilient compressible filler strip in the bottom of the groove.

1 Claim, 3 Drawing Figures

DOOR SILL AND ADJUSTABLE THRESHOLD

FIELD OF THE INVENTION

Movable or removable closures, threshold, adjustable in Class 49, subclass 468.

OBJECT OF THE INVENTION

The object of this invention is to provide a vertically adjustable threshold strip which is screwed down against a resilient plastic filler strip in the bottom of an elongate groove in a door sill. A further object is to provide an elongate vertically adjustable threshold strip having an overhanging ledge along each of the longitudinal edges of the strip for deflecting down-falling water or debris away from the joints between the strip and sides of the groove in which it engages, these ledges being rounded on their tops to provide curved surfaces against which bottom of a tight-fitting door slides when the latter swings shut.

These and other objects will be apparent in the following specification and drawing in which.

Figure 2:
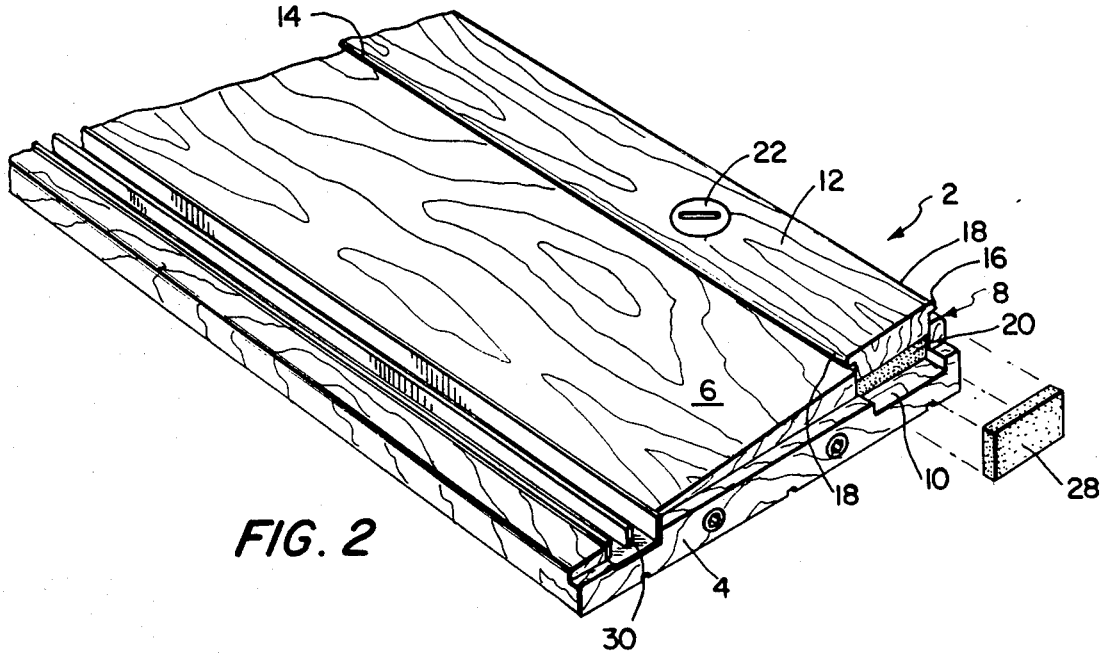
FIG. 2 is a perspective view of one end of the combined door sill and adjustable threshold shown in FIG. 1, with an end gasket separated from the end of the groove in which the threshold strip engages; and, FIG. 3 is a cross-section along the line 3—3 of FIG. 1.
Figure 1:
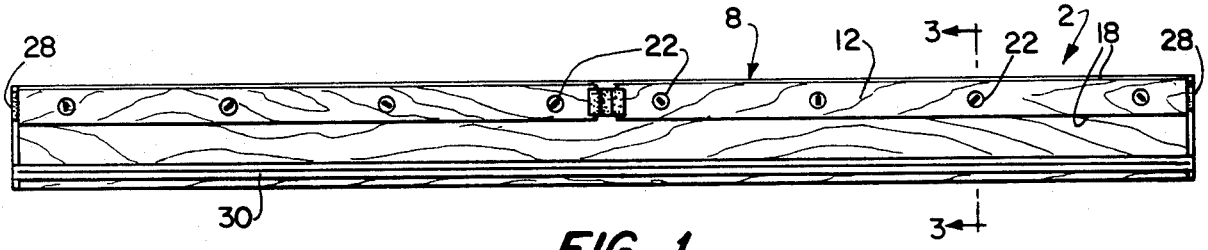
FIG. 1 is a plan view of the combined door sill and adjustable threshold.
Figure 3:
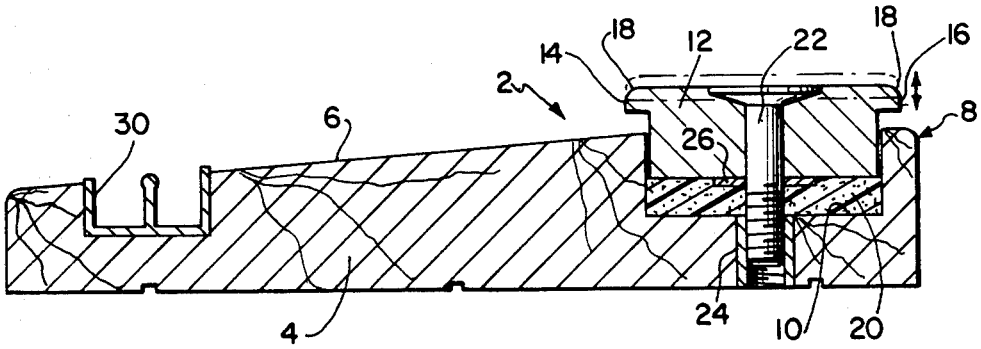

Referring now to the drawings in which like reference numerals denote similar elements, the combined door sill and threshold 2 is comprised of a wooden sill 4 having an inclined upper tread 8 terminating in a threshold portion 8 in which is disposed a longitudinal groove 10. Slidably engaged in groove 10 is an elongate threshold strip 12 which has overhanging ledges 14, 16 with rounded upper surfaces 18. In the bottom of groove 10 is a compressible plastic filler 20 against which strip 12 is screwed down by screws 22 engaging in nuts sleeves 24 in the bottom of groove 10. Washers 26 secured to the shanks of the screws hold the latter captive in strip

12. Compressible plastic gaskets 28 close the ends of the groove.

Filler 20 is foam plastic with closed cells which are non-absorbent of moisture. All of the groove space below strip 12 being displaced by the filler, there is no space in which water can be accumulated. If desired, a screen door slideway 30 may be provided the upper tread surface 6.

In operation, the sill is useable for either an in-swinging or an out-swinging door; its adjustability allows the alignment of the threshold with door buttom to make a weather tight and energy efficient joint, and the overhanging ledges along the opposite upper sides of the threshold strip provide rounded surfaces on which the door bottom can slide and which also shield the joints between the threshold strip sides and the adjacent sides of the groove.

I claim:

1. A combined door sill and adjustable threshold comprising an elongate wooden sill having opposite longitudinal edge portions, a tread portion inclined upwardly from one longitudinal edge portion and an elongate upwardly-open groove adjacent the other longitudinal edge portion, said groove having laterally spaced side walls and a bottom wall extending therebetween, an elongate threshold strip slidably engaging in the groove and substantially spanning the space between the side walls of the groove, a yieldable foam plastic filler with closed cells engaged between the threshold strip and the obottom of the groove, said filler occupying the entire space between the bottom of the threshold strip and the bottom wall of the groove and extending from side wall to side wall of said groove, and screw and nut means respectively in the strip and groove bottom for driving the threshold strip upwardly and downwardly in the groove, said threshold strip having outwardly extending overhanging ledges along each side thereof, said ledges overhanging the sill adjacent each side of the groove.

* * * * *